United States Patent [19]

Ringgenberg

[11] Patent Number: 4,657,083

[45] Date of Patent: Apr. 14, 1987

[54] PRESSURE OPERATED CIRCULATING VALVE WITH RELEASABLE SAFETY AND METHOD FOR OPERATING THE SAME

[75] Inventor: Paul D. Ringgenberg, Duncan, Okla.

[73] Assignee: Halliburton Company, Duncan, Okla.

[21] Appl. No.: 797,730

[22] Filed: Nov. 12, 1985

[51] Int. Cl.[4] ..... E21B 34/10

[52] U.S. Cl. ..... 166/374; 166/386; 166/323; 166/324

[58] Field of Search ..... 166/162, 169, 336, 373, 166/374, 386, 250, 264, 320, 321, 323, 324, 240

[56] References Cited

U.S. PATENT DOCUMENTS

| | | | |
|---|---|---|---|
| Re. 29,638 | 5/1978 | Nutter . | |
| 3,051,240 | 8/1962 | Fisher, Jr. | 166/331 X |
| 3,823,773 | 7/1974 | Nutter . | |
| 3,850,250 | 11/1974 | Holden et al. . | |
| 3,856,085 | 12/1974 | Holden et al. . | |
| 3,858,649 | 1/1975 | Wray et al. . | |
| 3,897,825 | 8/1975 | Tausch | 166/321 |
| 3,930,540 | 1/1976 | Holden et al. | 166/374 |
| 3,964,544 | 6/1976 | Farley et al. . | |
| 3,970,147 | 7/1976 | Jessup et al. . | |
| 3,986,554 | 10/1976 | Nutter . | |
| 4,063,593 | 12/1977 | Jessup . | |
| 4,064,937 | 12/1977 | Barrington . | |
| 4,113,012 | 9/1978 | Evans et al. | 166/371 X |
| 4,125,165 | 11/1978 | Helmus . | |
| 4,270,610 | 6/1981 | Barrington . | |
| 4,311,197 | 1/1982 | Hushbeck . | |
| 4,324,293 | 4/1982 | Hushbeck | 166/264 X |
| 4,328,866 | 5/1982 | Zimmerman . | |
| 4,355,685 | 10/1982 | Beck . | |
| 4,403,659 | 9/1983 | Upchurch . | |
| 4,445,571 | 5/1984 | Hushbeck . | |
| 4,452,313 | 6/1984 | McMahan . | |
| 4,474,242 | 10/1984 | Upchurch . | |
| 4,498,536 | 2/1985 | Ross et al. | 166/250 |

OTHER PUBLICATIONS

U.S. application Ser. No. 596,321 filed Apr. 3, 1984 entitled "Multi-Mode Testing Tool" by Paul David Ringgenberg.

Halliburton Drawing 615.4121.

Halliburton Drawing 615.4116 TC 014-0002-12.

*Primary Examiner*—Stephen J. Novosad

*Assistant Examiner*—William P. Neuder

*Attorney, Agent, or Firm*—Joseph A. Walkowski

[57] ABSTRACT

Pressure operated circulation valve with releasable safety and method for operating the same. A valve mandrel slidably received within a housing is frangibly restrained in a lower position blocking a circulation port through the housing. An upper power mandrel is frangibly restrained in a lower position beneath the valve mandrel for moving the valve mandrel upwardly responsive to an increase in internal housing pressure. A safety mandrel is frangibly restrained beneath the upper power mandrel and blocks communication of internal housing pressure to the lower end of the upper power mandrel until the safety mandrel is moved upwardly responsive to an increase in annulus pressure. Thus, the circulation valve is opened by first raising the annulus pressure by a pre-determined amount and thereafter increasing internal housing pressure.

19 Claims, 7 Drawing Figures

Figure 1:
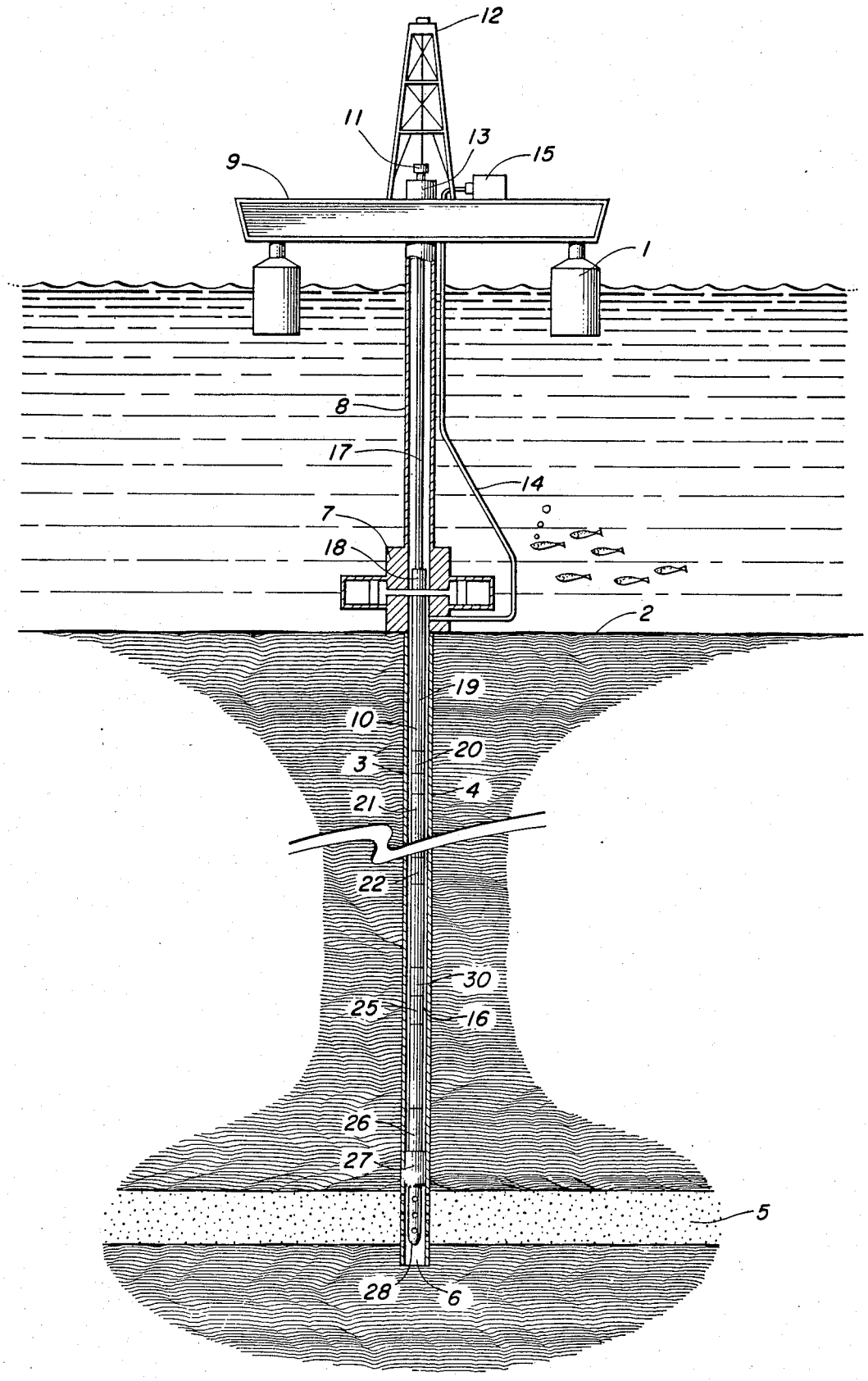

PRESSURE OPERATED CIRCULATING VALVE WITH RELEASABLE SAFETY AND METHOD FOR OPERATING THE SAME

The present invention relates generally to apparatus and methods for testing an oil well, and more particularly, but not by way of limitation, to a pressure operated circulation valve which may be placed in a circulating condition only after a pressure operated safety is released.

Most prior art circulating valves of the sliding sleeve type are opened in response to annulus pressure. Examples of such are U.S. Pat. No. 4,064,937 to Barrington and U.S. Pat. No. 3,970,147 to Jessup et al. There are prior art circulating valves which open in response to internal pressure communicated to the valve via the drill string.

It may be desirable to use an internal pressure operated circulation valve when there are a number of tools in a drill string to be operated by application of annulus pressure. Often such tools are restrained in a first condition with a pre-determined number of shear pins. Application of annulus pressure to a selected level will shear the pins and thus permit operation of the tool. If there are a number of such tools to be operated at different times, each tool must be set to operate at a different pressure. Typically at least 500 p.s.i. separates the pressures at which each tool operates. It can be seen that if there are for example, five tools, the last tool to be operated requires a pressure of 2500 p.s.i. High pressures may damage the well casing. In such instances, if a circulation valve is to be used it may be desirable to use one of the internal pressure operated type to reduce the maximum annulus pressure which must be used to operate the drill string tools.

Internal pressure operated circulation valves may be inadvertently opened as the result of an increase in drill string pressure. For example, when a drill string is made up and lowered into a well bore, it is desirable to periodically pressure test the drill string to assure that the drill pipe joints have been adequately made up. Such testing requires closing of a valve in the lower part of the drill string and applying pump pressure to the interior of the drill string at the surface of the well. If the drill string includes an interior pressure operated circulation valve, it may be inadvertently opened during a drill string pressure test.

When the drill string is in position it may be necessary to fracture or acidize the formation of interest. Such operations require injecting fluids into the formation via the drill string. During such injections drill string pressure may rise to a level at which the circulation valve is inadvertently opened.

The instant invention comprises a housing having an operating element disposed therein. Operating means are operatively disposed with the housing for operating the operating element in response to a pressure difference across the housing. Releasable safety means are operatively associated with the operating element and the operating means for initially preventing operation of the operating element by the operating means until a pre-determined pressure difference having a gradient opposite to the pressure difference for operating the operating element is applied across the housing.

It is to be appreciated that the following written description and accompanying drawings disclose an embodiment of the invention in which the operating element is a circulation valve. The instant invention is equally well suited for operating other valves or tools in which may be disposed in a drill string.

Numerous objects, features, and advantages of the present invention will be readily apparent to those skilled in the art upon reading the following written description when taken in conjunction with the accompanying drawings.

FIG. 1 is a schematic elevation view of a typical well testing apparatus using the present invention.

FIGS. 2A–2F comprise an elevational quarter section view showing a downhole tool constructed in accordance with the instant invention.

During the course of drilling an oil well, the borehole is filled with a fluid known as drilling fluid or drilling mud. One of the purposes of this drilling fluid is to contain in intersected formations any fluid which may be found there. To contain these formation fluids the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus closing in the formation from the hydrostatic pressure of the drilling fluid in the well annulus. Alternately, the string may be stabbed into a previously set production packer.

The valve at the lower end of the testing string is then opened and the formation fluid, free from the restraining pressure of the drilling fluid, can flow into the interior of the testing string.

The testing program includes periods bf formation flow and periods when the formation is closed in. Pressure recordings are taken throughout the program for later analysis to determine the production capability of the formation. If desired, a sample of the formation fluid may be caught in a suitable sample chamber.

At the end of the testing program, a circulation valve in the test string is opened, formation fluid in the testing string is circulated out, the packer is released, and the testing string is withdrawn.

Over the years various methods have been developed to open the tester valves located at the formation depth as described. These methods include string rotation, string reciprocation, and annulus pressure changes. Particularly advantageous tester valves are those shown in U.S. Pat. Nos. 3,856,086 to Holden, et al., 4,422,506 and 4,429,748 to Beck, and 4,444,268 and 4,448,254 to Barrington. These valves operate responsive to pressure changes in the annulus and provide a full opening flow passage through the tester valve apparatus.

The annulus pressure operated method of opening and closing the tester valve is particularly advantageous in offshore locations where it is desirable to the maximum extent possible, for safety and environmental protection reasons, to keep the blowout preventors closed during the major portion of the testing procedure.

A typical arrangement for conducting a drill stem test offshore is shown in FIG. 1. Such an arrangement would include a floating work station 1 stationed over a submerged work site 2. The well comprises a well bore 3 typically lined with a casing string 4 extending from the work site 2 to a submerged formation 5. The casing string 4 includes a plurality of perforations at its lower end which provide communication between the formation 5 and the interior of the well bore 6.

At the submerged well site is located the well head installation 7 which includes blowout preventor mechanisms. A marine conductor 8 extends from the well head installation to the floating work station 1. The floating work station includes a work deck 9 which supports a derrick 12. The derrick 12 supports a hoisting means 11. A well head closure 13 is provided at the upper end of marine conductor 8. The well head closure 13 allows for lowering into the marine conductor and into the well bore 3 a formation testing string 10 which is raised and lowered in the well by hoisting means 11.

A supply conduit 14 is provided which extends from a hydraulic pump 15 on the deck 9 of the floating station 1 and extends to the well head installation 7 at a point below the blowout preventors to allow the pressurizing of the well annulus 16 surrounding the test string 10.

The testing string includes an upper circuit string portion 17 extending from the work site 1 to the well head installation 7. A hydraulically operated conduit string test tree 18 is located at the end of the upper conduit string 17 and is landed in the well head installation 7 to thus support the lower portion of the formation testing string. The lower portion of the formation testing string extends from the test tree 18 to the formation 5. A packer mechanism 27 isolates the formation 5 from fluids in the well annulus 16. A perforated tail piece 28 is provided at the lower end of the testing string 10 to allow fluid communication between the formation 5 and the interior of the tubular formation testing string 10.

The lower portion of the formation testing string 10 further includes intermediate conduit portion 19 and torque transmitting pressure and volume balanced slip joint means 20. An intermediate conduit portion 21 is provided for imparting packer setting weight to the packer mechanism 27 at the lower end of the string.

It is many times desirable to place near the lower end of the testing string a conventional circulating valve 22 which may be opened by rotating or reciprocation of the testing string or a combination of both or by the dropping of a weighted bar in the interior of the testing string 10. This circulation valve is provided as a back-up means to provide for fluid communication in the event that the circulation valve of the present apparatus should fail to open properly. Also near the lower end of the formation testing string 10 is located a tester valve 25 which is preferably a tester valve of the annulus pressure operated type such as those disclosed in U.S. Pat. Nos. 3,856,085; 4,422,506; 4,429,748; 4,444,268; and 4,448,254. Immediately above the tester valve is located a tool 30 which incorporates the apparatus of the present invention.

A pressure recording device 26 is located below the tester valve 25. The pressure recording device 26 is preferably one which provides a full opening passageway through the center of the pressure recorder to provide a full opening passageway through the entire length of the formation testing string.

It may be desirable to add additional formation testing apparatus in the testing string 10. For instance, where it is feared that the testing string 10 may become stuck in the borehole 3 it is desirable to add a jar mechanism between the pressure recorder 26 and the packer assembly 27. The jar mechanism is used to impart blows to the testing string to assist in jarring a stuck testing string loose from the borehole in the event that the testing string should become stuck. Additionally, it may be desirable to add a safety joint between the jar and the packer mechanism 27. Such a safety joint would allow for the testing string 10 to be disconnected from the packer assembly 27 in the event that the jarring mechanism was unable to free a stuck formation testing string.

The location of the pressure recording device may be varied as desired. For instance, the pressure recorder may be located below the perforated tail piece 28 in a suitable pressure recorder anchor shoe running case. In addition, a second pressure recorder may be run immediately above the tester valve 25 to provide further data to assist in evaluating the well.

Referring now to FIGS. 2A–2F, indicated generally at 30 is the downhole tool constructed in accordance with the instant invention. Tool 30 includes a cylindrical outer housing generally designated by the numeral 31 having an upper housing adapter 32 which includes threads 34 for attaching tool 30 to the portion of testing string 10 located above tool 30.

At the lower end of housing 31 is a lower housing adapter 36 which includes an external threaded portion 38 for connection of tool 30 to that portion of testing string 10 located below tool 30.

Tool 30 may be conveniently divided into five major portions including a circulation valve portion 40, an upper power mandrel portion 42, a safety mandrel portion 44, a lower power mandrel portion 46, and a safety closure valve portion 48.

Circulation valve portion 40 includes a circulation valve upper housing section 50 and a circulation valve lower housing section 52. Circulation valve lower housing section 52 is threadably connected to upper power mandrel housing section 54 at threaded connection 56.

Figure 2A:
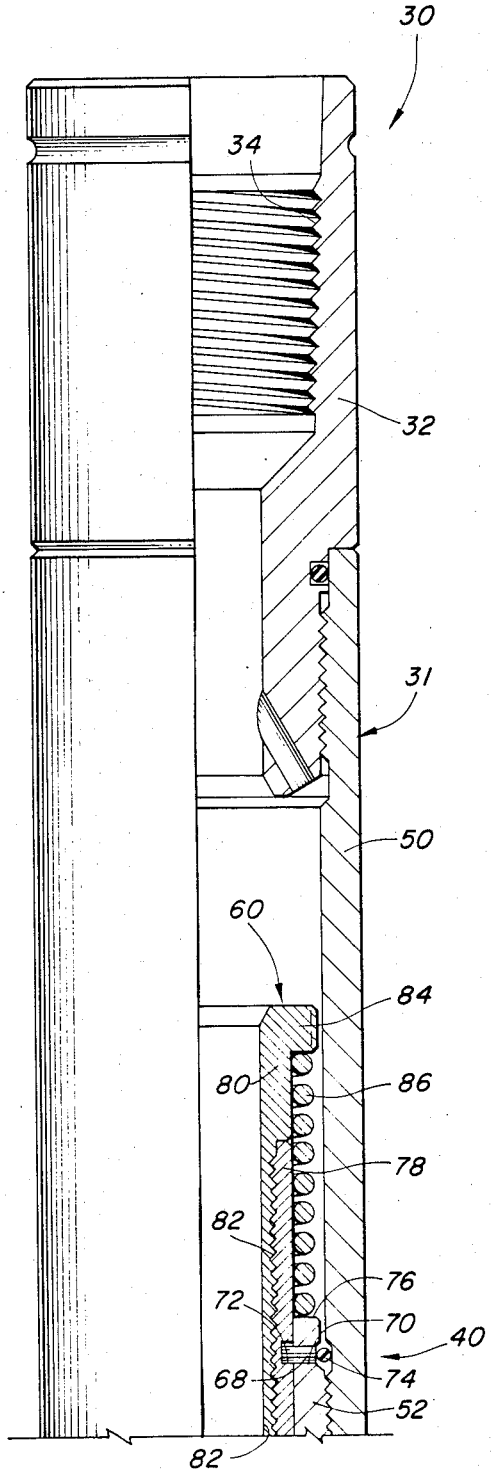
Figure 2B:
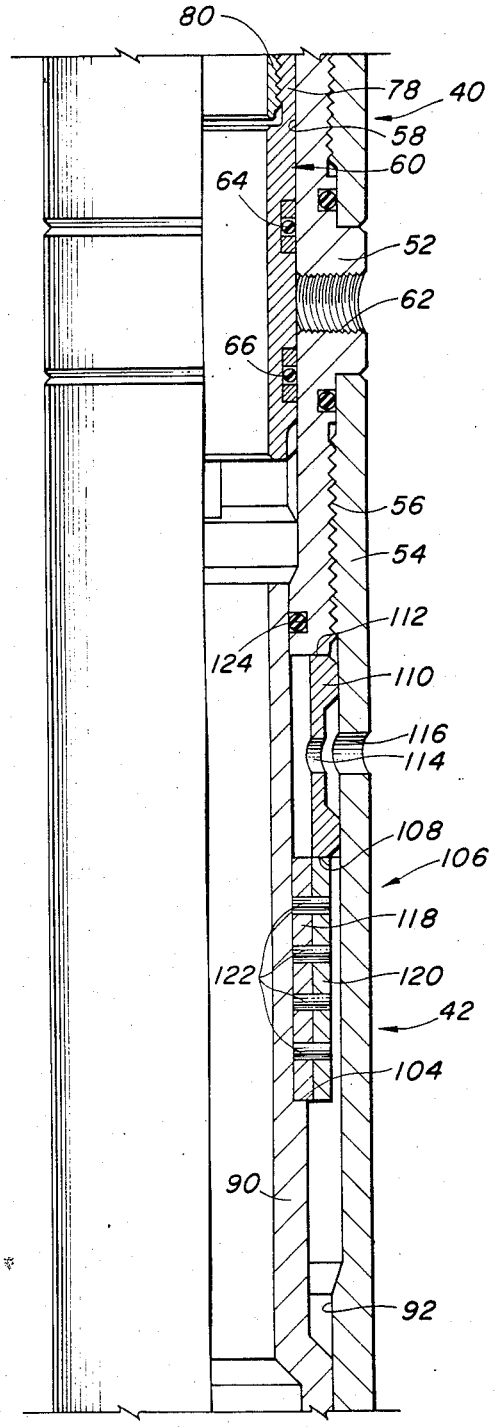

Slidingly received within an inner bore 58 of circulation valve lower housing section 52 is a valve mandrel 60. Valve mandrel 60 as shown in FIGS. 2A–2B is in its closed position closing a circulation port 62 with upper and lower annular seals 64, 66, located between valve mandrel 60 and bore 58, sealing above and below circulating port 62.

Valve mandrel 60 is initially retained in its closed position by a valve mandrel shear pin 68 which is disposed through a radial bore 70 through valve lower housing section 52 and received within a radially extending bore 72 of valve mandrel 60. Shear pin 68 is retained in place by a resilient retaining ring 74.

An annular upper end surface 76 of valve housing lower section 52 defines a radially inwardly projecting ledge of cylindrical housing 31.

Valve mandrel 60 includes a lower valve mandrel portion 78 and an upper valve mandrel portion 80. Upper valve mandrel portion 80 includes an externally threaded lower end portion which is threadably engaged with an internally threaded upper end portion of lower valve mandrel portion 78 via threaded connection 82. Upper valve mandrel portion 80 includes a radially outwardly projecting annular ledge 84 located above annular upper end surface 76.

A coil compression spring 86 has its upper end engaging outward projecting ledge 84 and has its lower end engaging annular upper end surface 76. Spring 86 provides a means for moving sliding valve mandrel 60 from its closed position as shown in FIGS. 2A–2B, to an open position with valve mandrel 60 moved upward relative to cylindrical housing 31 so that circulating port 62 is uncovered and allowed to communicate with the interior of cylindrical housing 31.

Spring 86 is initially retained in a compressed state until shear pin 68 is sheared and then spring 86 moves valve mandrel 60 upward to its open position upon expansion of the spring.

Upper power mandrel portion 42 includes an upper power mandrel 90, such also being referred to herein as operating means or valve piston means, which is closely received within an inner bore 92 of upper power mandrel housing section 54.

Upper power mandrel section housing 54 includes an inwardly projecting annular shoulder 94 (in FIG. 2C) against which the lower end of upper power mandrel 90 is abutted. A safety mandrel 96 is closely received within the lower end of an interior bore 98 of upper power mandrel 90. An annular seal 100 seals between upper power mandrel 90 and upper power mandrel section housing 54. An annular seal 102 seals between the interior of upper power mandrel 90 and the radially outer surface of safety mandrel 96.

Turning back to FIG. 2B, upper power mandrel 90 includes an upwardly directed annular shoulder 104 formed about the radially outer circumference thereof. Frangible restraining means, indicated generally at 106 is held in position as shown between shoulder 104 and a lower end 108 of an annular collar 110. An upper end 112 of the collar is abutted against the lower end of circulation valve lower housing section 52 and thus restrains power mandrel 90 from upward movement. Annular collar 110 includes a bore 114 therethrough which permits fluid communication between the interior and exterior of the collar. A port 116 is formed in upper power mandrel housing section 54 adjacent bore 114.

Restraining means 106 includes inner and outer concentric sleeves 118, 120 having a plurality of shear pins 122 disposed radially therethrough connecting the inner and outer concentric sleeves.

As will later be more fully described, restraining means 106 maintains upper power mandrel 90 abutted against shoulder 94 (in FIG. 2C) until upwardly directed pressure on power mandrel 90 is sufficient to shear pins 122 thus permitting upward movement of mandrel 90. A seal 124 seals the upper end of upper power mandrel 90 between the radially outer surface thereof and the radially inner surface of circulation valve lower housing section 52.

Figure 2C:
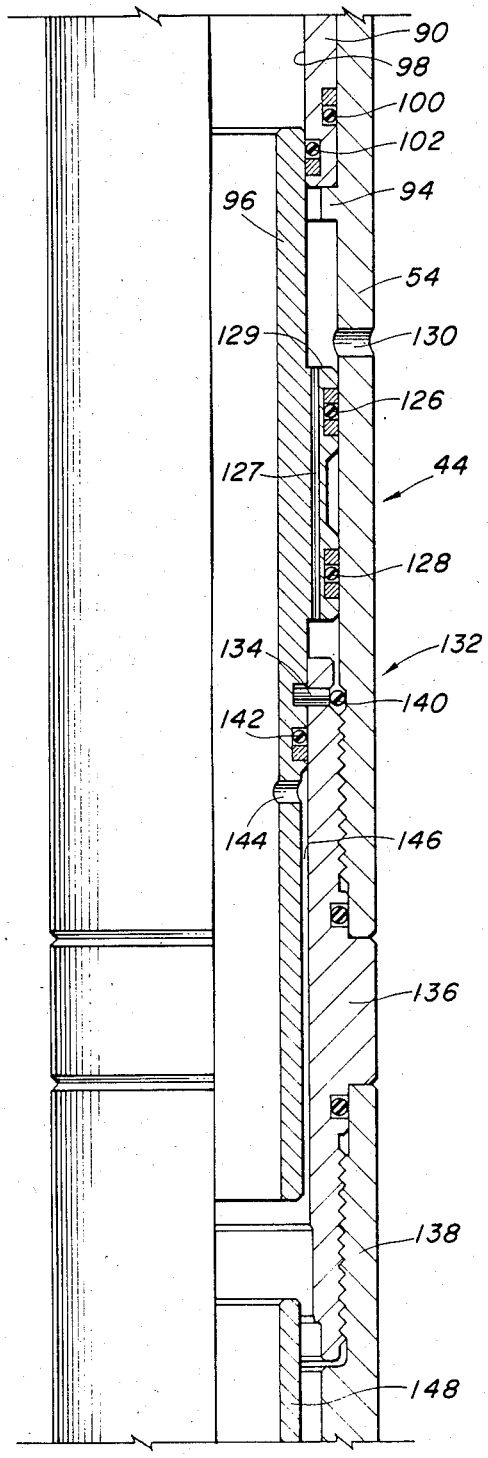
Figure 2D:
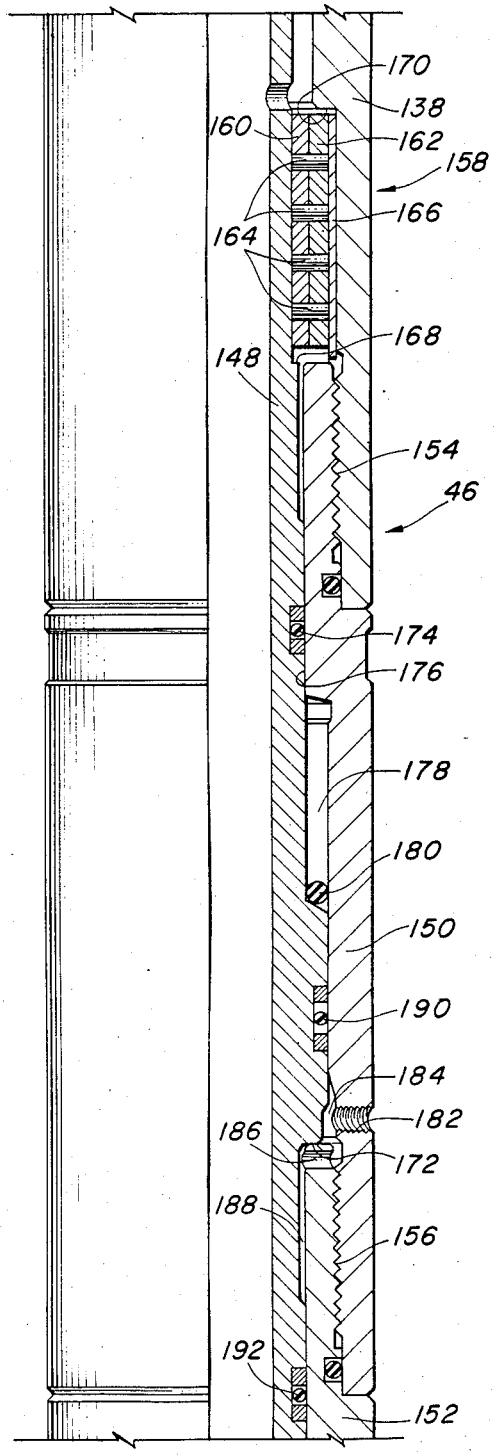
Figure 2E:
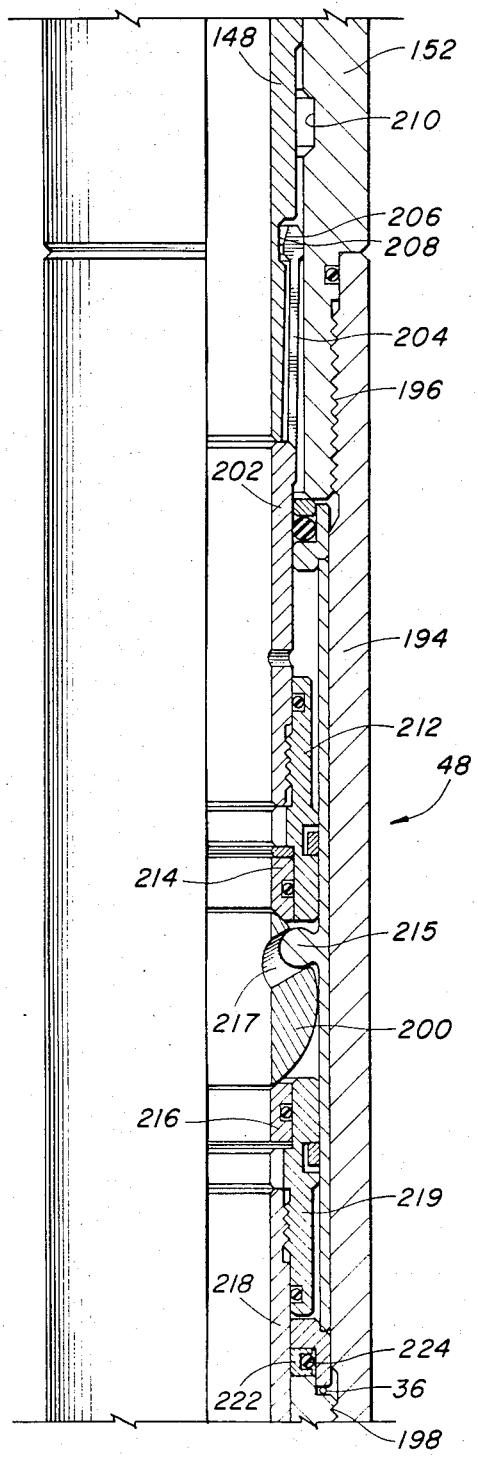
Figure 2F:
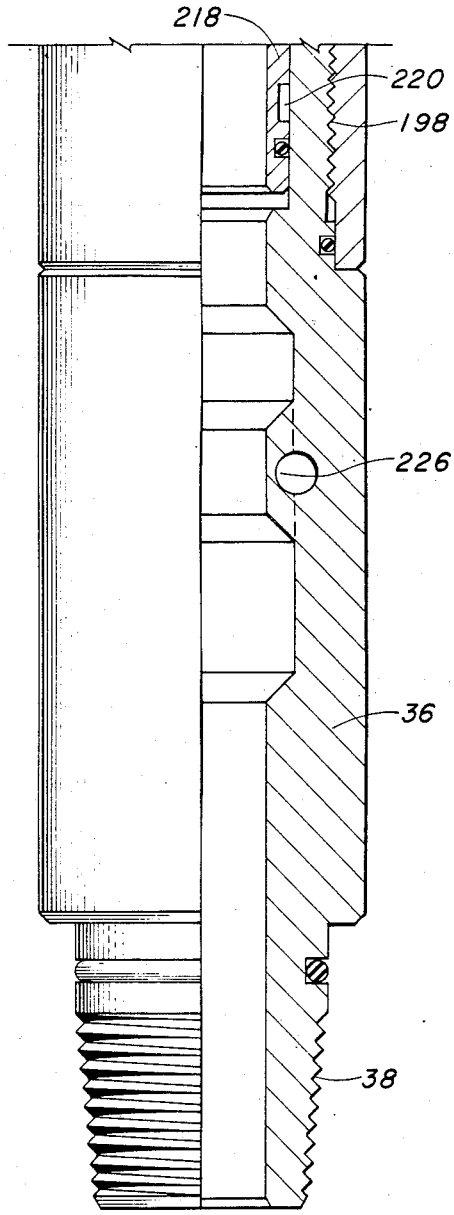

Considering now safety mandrel portion 44 in FIG. 2C, safety mandrel 96 includes a pair of seals 126, 128 which provide a seal between the safety mandrel and the radially inner surface of upper power mandrel housing section 54 about the radially inner circumference thereof. A passageway 127 permits fluid communication above and below seals 126, 128 in the annular space between safety mandrel 96 and upper power mandrel housing section 54. The safety mandrel includes an upwardly directed annular shoulder 129. Section 54 includes a port 130 formed therethrough which is immediately above seal 126 when safety mandrel 96 is in the configuration of FIG. 2.

Safety mandrel 96 is frangibly restrained in the position shown via restraining means, indicated generally at 132. Restraining means 132 includes a shear pin 134 which is received in a pair of opposing bores formed in safety mandrel 96 and in a safety mandrel housing section 136. Safety mandrel housing section 136 is threadably secured at its upper end to upper power mandrel housing section 54 and at its lower end to a restraining means housing section 138. A resilient retaining ring 140 holds shear pin 134 within the bores in safety mandrel 96 and safety mandrel housing section 136 as shown. A seal 142 seals between the outer surface of the safety mandrel and the inner surface of the safety mandrel housing section as shown. Immediately beneath seal 142 is a bore 144 formed through the safety mandrel which permits fluid communication between the interior of the safety mandrel and an annular space 146 formed between the radially outer surface of the safety mandrel and the radially inner surface of safety mandrel housing section 136.

Lower power mandrel portion 46 includes therein a lower power mandrel 148. The lower power mandrel is received within restraining means housing section 138, a lower power mandrel housing section 150 and a safety closure valve upper housing section 152. Housing section 138 is threadably secured via threads 154 to housing section 150 which in turn is threadably secured via threads 156 to housing section 152.

Lower power mandrel 148 is prevented from upward movement by restraining means 158. Restraining means 158 includes inner and outer concentric sleeves 160, 162 having a plurality of shear pins 164 disposed radially therethrough connecting the inner and outer sleeves. A shear pin cover 166 surrounds outer sleeve 162 to hold the shear pins in place within sleeves 160, 162.

A shoulder 168 formed on the radially outer surface of lower power mandrel 148 about the circumference thereof cooperates with a downwardly-directed shoulder 170 formed on the radially inner surface of restraining means housing section 138 to prevent upward movement of lower power mandrel 148 until a predetermined upwardly directed force sufficient to shear pins 164 is applied to the lower power mandrel.

Lower power mandrel 148 is prevented from downward movement by the action of a downwardly-directed shoulder 172 formed on the radially outer surface of the lower power mandrel acting against the upper end of safety closure valve upper housing section 152.

A seal 174 seals between the radially outer surface of the lower power mandrel and a radially inner surface 176 of lower power mandrel housing section 150. An annular space 178 is formed between the outer surface of lower power mandrel 148 and the inner surface of lower power mandrel housing section 150. Annular space 178 includes air at atmospheric pressure which is entrapped therein when the tool is assembled at the surface.

An elastomeric cushion ring 180 is located in space 178 to help absorb the shock as lower power mandrel 148 moves to an upper position in response to upwardly directed fluid pressure applied to the lower power mandrel.

Such pressure is applied via a power port 182, formed through lower power mandrel housing section 150, which communicates with annular space 184 and, via bore 186 formed through safety closure valve upper housing section 152, with annular space 188. Annular space 184 is sealed at its upper end by a seal 190 while annular space 188 is sealed at its lower end by a seal 192. Application of pressure to the annulus of the well bore in which tool 30 is suspended is communicated via bore 182 to spaces 184, 186 thus urging the power mandrel upwardly. When sufficient pressure is applied, pins 164 shear thus permitting the lower power mandrel to move upwardly.

Safety closure valve portion 48 includes safety closure valve upper housing section 152 and a safety closure valve lower housing section 194 which is threadably secured at its upper end to housing 152 via threads 196 and is threadably secured at its lower end to lower housing adapter 36 via threads 198.

Safety closure valve portion 48 includes therein a ball valve 200 which is operated by an operating assembly that includes a pull mandrel 202 releasably attached to the lower portion of lower power mandrel 148 by a plurality of spring fingers, one of which is finger 204. Each spring finger is terminated by a head 206. Each of the heads is forced by the lower power mandrel into a groove 208 in the lower portion of lower power mandrel 148. Safety closure valve upper housing section 152 also includes an annular recess 210. The spring fingers, like spring finger 204, are outwardly biased so that when heads 206 are pulled by lower power mandrel 148 upwardly over recess 210, the spring fingers snap outwardly moving heads 206 into recess 210. This action disconnects pull mandrel 202 from groove 208 of lower power mandrel 148.

The ball operating mechanism additionally includes an upper seat retainer 212 which retains upper valve seat 214. Below seat 214 is ball valve 200 and its associated lower valve seat 216. A pin 215 is received in a hole 217 in ball valve 200.

Lower valve seat 216 is carried by a lower seat retainer 219, the lower end of which is threadably attached to a locking mandrel 218. The locking mandrel includes an annular groove 220 formed about the radially outer circumference of the locking mandrel.

A plurality of locking dogs, one of which is locking dog 222 are disposed about the circumference of the locking mandrel and are biased inwardly thereagainst by a resilient o-ring 224. When pull mandrel 202 moves upwardly until groove 220 is opposite the locking dogs, o-ring 224 biases the dogs into the groove thereby locking ball valve 200 in a closed position. For a more detailed description of ball valve 200, the structure associated therewith, and its method of operation, attention is directed to U.S. Pat. No. 4,445,571 to Hushbeck which is incorporated herein by reference.

A drain passage 226 is formed in lower housing adapter 36. As set out above, the present tool is often used in connection with an annulus pressure operated tester valve 25 (in FIG. 1) such as the one shown in U.S. Pat. No. 3,856,085. When run with such a tester valve 25, it is desirable to provide a means to drain well fluids trapped between ball valve 200 and tester valve 25 located below tool 30 in testing string 10. Thus a drain passage 226 is provided in lower adapter 36 to allow the draining of formation fluid trapped between ball valve 200 and tester valve 25. For a description of the structure and manner of operation of a plug valve for use in association with drain passage 226, attention is directed to the Hushbeck patent.

Consideration will now be given to the manner of operation of tool 30. The tool is initially assembled at the surface as shown in FIGS. 2A–2F. Thereafter, it is incorporated into a testing string like that shown in FIG. 1 and lowered into the well bore as shown in FIG. 1.

When in the configuration of FIG. 1, tester valve 25 may be repeatedly opened and closed by application of annulus pressure in order to conduct a drill string test. Thereafter, fluids may be pumped through the drill string and into the formation, for example, for acid-treating the formation. After testing and treatment, but prior to raising the drill string, it is desirable to reverse circulate fluids from the drill string before lifting the string from the well bore. Such is accomplished by moving the circulation valve mandrel upwardly so that circulation port 62 is in communication with the interior of housing 31. Thereafter, fluid is pumped downwardly in the annulus through port 62 and upwardly through the drill string thereby circulating well fluids from the drill string.

The circulation valve is opened by first applying a predetermined pressure to the annulus fluids and thereafter pressurizing the drill string as follows. With the tool in the configuration of FIGS. 2A–2F and suspended on a testing string as shown in FIG. 1, pressure is applied to the annulus fluid. Such pressure is applied to annular spaces 184, 188 via power port 182. Seal 190 defines an outer diameter and seal 192 an inner diameter of a downward facing surface of lower power mandrel 148. The pressurized fluid in annular spaces 182, 184, acts upwardly against this surface. When the pressure reaches the pre-determined level necessary to shear pins 164 in restraining means 158, lower power mandrel 148 moves quickly upwardly with the upper end of power mandrel 148 abutting against lower end of safety mandrel 96.

As lower power mandrel 148 moves upwardly, under the influence of annulus pressure acting through port 182, the entire ball operating assembly comprised of pull mandrel 202, upper seat retainer 212, ball valve 200 with its associated valve seats 214, 216, lower seat retainer 219, and locking mandrel 218 all move in the upward direction as long as the finger heads, like head 206 of finger 204, are engaged with groove 208 in lower power mandrel 148. During this upward movement, ball valve 200 will be rotated to the closed position by the action of pin 215 in hole 217 of ball valve 200. Thus, after lower mandrel 148 is urged upwardly, ball valve 200 is closed thereby preventing fluid communication through housing 31 above the ball valve. Ball valve 200 serves as a safety closure valve backup to tester valve 25 to assure that when the circulation valve is opened, pressure from the formation will not be communicated above ball valve 200.

When lower power mandrel 148 strikes the lower end of safety mandrel 96, pin 134 is sheared thereby urging safety mandrel 96 upwardly. Such upward movement causes seals 126, 128 to be placed above and below port 130 thereby sealing port 130 from the interior of housing 31. When shoulder 129 of safety mandrel 96 impacts the downwardly-directed portion of shoulder 94, upward movement of the safety mandrel stops.

After safety mandrel 96 is moved to its upper position as described, the drill string is pressurized thus permitting pressurized fluid to be communicated through port 144 (in FIG. 2C) in safety mandrel 96 into the annular space between safety mandrel 96 and upper power mandrel housing section 54 since seal 142 is above the upper end of safety mandrel housing 136.

The pressurized fluid is communicated above seals 126, 128 via passageway 127 to the lower end of upper power mandrel 90. Seals 100, 102 seal the inner and outer surfaces of mandrel 90. Seal 100 defines an outer diameter and seal 124 (FIG. 2B) an inner diameter of a downward facing surface of upper power mandrel 90.

The pressurized fluid in housing 31 acts upwardly against this surface. When such pressure reaches a predetermined level sufficient to shear pins 122, upper power mandrel 90 moves suddenly upward with the upper end thereof striking the lower end of valve mandrel 60. When such occurs, pin 68 shears thus enabling spring 86 to urge valve mandrel 60 upwardly until shoulder 84 strikes the lower end of upper housing adapter 32. In the upper position of the valve mandrel, seal 66 is above port 62 and thus fluid communication is permitted between the annulus and the interior of housing 31 thereby allowing reverse circulation.

It can be seen that the above-described method and apparatus offers several advantages. When the tool is lowered in the well bore in the configuration of FIGS. 2A–2F, the pressure on either side of upper power mandrel 90 is substantially balanced as follows. Annulus pressure is communicated with the lower end of mandrel 90 via port 130. Annulus pressure is communicated to an upwardly directed surface of the power mandrel above seals 100, 102 via port 116 and bore 114 in annular collar 110. Thus, variations in annulus pressure will not stress shear pins 122.

When tool 30 is being lowered into the well bore on the testing string, it may be desirable to periodically pressure test the drill string. Such is accomplished by closing tester valve 25, or by closing a similar closure valve provided specifically for drill string testing, and thereafter pressurizing the drill string. Such testing assures that all of the pipe joints in the drill string have been properly made up and tightened.

It can be seen that during a drill string pressure test, there is no risk of inadvertantly opening circulation port 62 since interior pressure is not communicated to the annular space above and below seals 126, 128. Before pressure in the drill string can be so communicated, safety mandrel 96 must be urged upwardly until seal 142 is above the upper end of safety mandrel housing 136 thereby permitting internal pressure to be communicated through bore 144 to the lower end of safety mandrel 90.

This feature also permits fluids, for example acid, to be injected into the formation during testing and treating with the drill string in the configuration of FIG. 1. Such injections may be made without the possibility of the circulation valve being inadvertantly opened.

It should be noted that the tool of the instant invention is as well suited for operating a circulation valve in a housing which does not have a safety valve, like valve 200, as it is for operating a circulation valve in a housing having a safety valve as disclosed in FIGS. 2A–2F. In other words, the tool can be used to operate a circulation valve, or other operating element, independent of operation of other tools or valves. In addition, the tool of the instant invention may be equally well used to operate a circulation valve in combination with a sampler valve. Circulation valve/sampler valve combinations are disclosed in U.S. Pat. No. 4,063,593 to Jessup and U.S. Pat. No. 4,064,937 to Barrington. Thus, addition of a second ball below ball valve 200 and a linkage as shown in the aforementioned patents provides a housing which incorporates the tool of the invention in a circulation valve/sampler valve combination.

Thus, the apparatus of the present invention is well adapted to obtain the ends and advantages mentioned as well as those inherent therein. While presently preferred embodiments of the method and apparatus of the invention have been described for the purpose of this disclosure, numerous changes in the construction and arrangements of parts and in the performance of the method can be made by those skilled in the art, which changes are encompassed in the scope of this invention as defined by the appended claims.

I claim:

1. A downhole tool comprising:

a housing;

an operating element disposed in said housing;

operating means comprising a mandrel operatively associated with and slidably received within said housing for operating said operating element in response to a pressure difference between the interior and the exterior of said housing; and releasable safety means comprising a mandrel operatively associated with and slidably received within said housing, said operating element and said operating means for initially preventing operation of said operating element by said operating means until a pressure difference having a gradient opposite to that of said pressure difference for operating said operating element is applied between the interior and the exterior of said housing.

2. The downhole tool of claim 1 wherein said operating means is arranged and constructed to operate said operating element in response to an increase in an internal pressure applied from within said housing.

3. The downhole tool of claim 1 wherein said safety means is arranged and constructed to initially prevent operation of said operating element by said operating means until pressure exterior of said housing has exceeded pressure within said housing by a pre-determined amount.

4. The downhole tool of claim 1 wherein said operating element comprises a circulation valve for permitting fluid flow through a circulating port formed through a wall in said housing.

5. The downhole tool of claim 1 wherein said apparatus further includes a second operating element disposed in said housing, said second operating element being operated by said releasable safety means when said pressure difference having a gradient opposite to that of said pressure difference for operating said operating element is applied.

6. The downhole tool of claim 5 wherein said housing includes an axial bore therethrough and said second operating element comprises a housing bore closure valve.

7. A downhole tool comprising:

a housing;

a circulating valve comprising a circulation port formed through a wall of said housing and a valve mandrel slidably received in said housing for blocking said circulating port in a first position and exposing said circulating port in a second position for permitting a flow between the interior and exterior of said housing, said valve mandrel being releasably maintained in said first position;

valve piston means slidably received in said housing for moving said valve mandrel to said second position in response to an internal pressure increase applied from within said housing; and a safety mandrel slidably received in said housing, said safety mandrel having a first position in which said valve piston means is prevented from moving said valve mandrel to said second valve mandrel position and a second position in which such movement is permitted, said safety mandrel being moved from said first safety mandrel position to said second safety mandrel position responsive to an increase in pressure exterior of said housing.

8. The downhole tool of claim 7 wherein said valve piston means includes first and second sides which are each subject to substantially the same pressure when said safety mandrel is in said first safety mandrel position and wherein said first side is subject to internal housing pressure and said second side is subject to pressure exterior of said housing when said safety mandrel is in said second safety mandrel position.

9. The downhole tool of claim 7 wherein said tool further includes safety piston means slidably received in said housing for moving said safety mandrel to said second safety mandrel position responsive to a predetermined increase in pressure exterior of said housing.

10. The downhole tool of claim 9 wherein said safety piston menas includes a first side subject to pressure exterior of said housing and a second side subject to internal housing pressure, said safety piston means being frangibly restrained beneath said safety mandrel prior to said pre-determined increase in exterior pressure.

11. The downhole tool of claim 10 whrein said safety piston means moves from a lower safety piston position to an upper safety piston position responsive to said pre-determined increase in exterior pressure and wherein said downhole tool further includes a housing closure valve operatively connected to said safety piston means, said valve being closed in response to movement of said safety piston means from said lower position to said upper position.

12. The downhole tool of claim 10 wherein said valve piston means includes a first end and a second end and wherein said safety mandrel includes a bore through a wall thereof, said bore being sealed when said safety mandrel is in said first safety mandrel position and said bore permitting communication between said housing interior andthe first end of said valve piston means when said safety mandrel is in said second safety mandrel position.

13. The downhole tool of claim 12 wherein said valve mandrel is frangibly restrained in said first valve mandrel position, said safety mandrel is frangibly restrained in said first safety mandrel position, and said valve piston means is frangibly restrained beneath said valve mandrel.

14. A method for operating an operating element disposed in the housing of a downhole tool comprising the steps of:

disposing releasable safety means in said housing for initially preventing operation of said operating element;

applying a first pressure difference between the interior and exterior of said housing to release said safety means for permitting operation of said operating element;

applying a second pressure difference between the interior and exterior of said housing having a gradient opposite to that of said first pressure difference to operate said operating element.

15. The method of claim 14 wherein the step of applying said first pressure difference comprises the step of increasing pressure exterior of said housing until said exterior pressure exceeds the internal pressure within said housing by a pre-determined amount.

16. The method of claim 14 wherein the step of applying a second pressure difference having a gradient opposite to said first pressure difference comprises the step of increasing internal pressure within said housing relative to that exterior of said housing.

17. The method of claim 14 wherein said method further includes the step of frangibly restraining a power mandrel in said housing adjacent said operating element for operating said operating element in response to an increase in internal pressure from within said housing which is communicated to one end of said power mandrel.

18. The method of claim 17 wherein the step of disposing releasable safety means in said housing for initially preventing operation of said operating element further comprises frangibly restraining a safety mandrel in said housing adjacent said power mandrel to prevent internal housing pressure from acting upon said one end of said power mandrel.

19. The method of claim 18 wherein said method further includes the step of frangibly restraining a second power mandrel in said housing adjacent said safety mandrel for moving said safety mandrel to a position in which internal housing pressure can be communicated to said one end of said first-mentioned power mandrel, such moving occurring responsive to increasing pressure exterior of said housing until said exterior pressure exceeds the internal pressure within said housing by a pre-determined amount.

* * * * *